United States Patent [19]

Thompson

[11] Patent Number: 4,583,804

[45] Date of Patent: Apr. 22, 1986

[54] ELECTRIC FEEDTHROUGH SYSTEM

[76] Inventor: Richard Thompson, 6007 Craigway, Spring, Tex. 77389

[21] Appl. No.: 612,407

[22] Filed: May 21, 1984

[51] Int. Cl.[4] ..... H01R 13/516

[52] U.S. Cl. ..... 339/60 M; 339/103 C; 339/218 R

[58] Field of Search ..... 339/59, 60, 94, 136, 339/141, 103, 107, 217, 218

[56] References Cited

U.S. PATENT DOCUMENTS

| | | | |
|---|---|---|---|
| 2,639,313 | 5/1953 | Street, Jr. | 339/103 B |
| 2,700,140 | 1/1955 | Phillips | 339/94 M |
| 3,091,750 | 5/1963 | Long et al. | 339/94 M |
| 3,158,680 | 11/1964 | Lovitt et al. | 339/94 M |
| 3,241,056 | 3/1966 | Lawrence, Jr. | 339/218 R |
| 3,477,061 | 11/1969 | Stephenson | 339/94 M |
| 3,598,941 | 8/1971 | Nelson | 339/60 M |
| 3,816,641 | 6/1974 | Iversen | 339/218 R |
| 3,851,296 | 11/1974 | Muchmore et al. | 339/60 M |
| 3,945,700 | 3/1976 | Didier | 339/59 M |
| 4,053,201 | 10/1977 | Grappe | 339/218 R |
| 4,181,394 | 1/1980 | Dodge | 339/218 R |
| 4,193,655 | 3/1980 | Herrmann, Jr. | 339/94 M |
| 4,266,844 | 5/1981 | Chelminski | 339/218 M |

FOREIGN PATENT DOCUMENTS

| | | | |
|---|---|---|---|
| 231270 | 11/1960 | Australia | 339/59 M |
| 2835400 | 2/1980 | Fed. Rep. of Germany | 339/218 R |
| 6607867 | 12/1966 | Netherlands | 339/103 C |

*Primary Examiner*—Neil Abrams

*Attorney, Agent, or Firm*—Jerome P. Bloom

[57] ABSTRACT

An electric feedthrough unit particularly advantageous for application to a wellhead to interconnect an aboveground source of power with underground equipment comprises a tubular structure of steel, or other material having like properties of strength and resistance to distortion, and a rigid body of insulating material which is positioned within said tubular structure in a location intermediately of and spaced from its respective ends, one of which ends constitutes an upper end and the other a lower end when said electric feedthrough unit is applied to a wellhead. Electrically conductive elements are contained by and in recessed relation to the outer surface of said body of insulating material, spaced from the respective ends of said tubular structure. Said body of insulating material is interposed between said conductive elements and said housing to receive and transmit to said housing such forces and stresses and strains as are applied thereto directly, or indirectly. The arrangement provides that the connections to said conductive elements are well recessed within the limits of said body of insulating material. A flexible dielectric material which requires neither homogeneity nor perfect bonding to the parts to insure the integrity of the feedthrough unit is applied to fill the spaces within said tubular structure except for those areas where respective end portions of the electrically conductive elements must be bare for their use in connecting an aboveground source of power with below ground equipment.

25 Claims, 13 Drawing Figures

ELECTRIC FEEDTHROUGH SYSTEM

BACKGROUND OF THE INVENTION

The present invention relates to electric feedthrough systems applied to transmit electrical power from an above ground source to equipment having a subterranean location. Its essential features insure the integrity of such a system, even under the most adverse conditions, and to a degree not heretofore achieved.

In the embodiment herein illustrated the invention is particularly concerned with that portion of a cable system which is projected through, connected to and depends from the head of a well to form a connection between an above ground cable connected to a source of electrical power and an underground cable connected to a pump which is submerged within the depths of the well. As is particularly well known in the oil industry, the maintenance of power to such a pump is critical and at the same time made difficult by reasons of the extreme in pressures and temperatures and the character and nature of the well fluids to which the portion of the electric feedthrough system at the wellhead is subjected.

That many problems have resulted from such circumstances has been frequently exhibited in the prior art apparatus applied for the same purpose. This is well known. These problems have stemmed from many factors not the least of which has been the design characteristics of prior art apparatus which in many cases include the requirement for complete bonding of insulators and dielectrics thereof to one another and to the conductors which they peripherally encase as well as to the shell or housing by which they themselves are encased. Such requirement is most difficult to satisfy. Apart from this, it is often difficult to introduce a dielectric material in such apparatus in a manner to render it void free. As will be self apparent, the existence of voids in a dielectric material makes such material highly susceptible to a structural breakdown under the exceedingly high differential of pressures and/or voltage to which it may be subjected in a well environment, particularly in the vicinity of a wellhead. Where bonding is not perfect and dielectrics are not void free, as will be obvious, the pressure and temperature conditions within a well will make that portion of the electric feedthrough apparatus with which we are presently concerned, at the vicinity of a wellhead, subject to infiltration by and seepage therein and therethrough of well fluids with many undesirable results, one or more of which will follow. Such undesirable results include short circuiting and interruption of the function of the pump being powered. However, this is not the worst. It can also produce an escape through the electric feedthrough system and the portion of the wellhead to which it mounts of fluids which are lethal and are contaminating to the atmosphere. Also arcing can result therefrom producing the danger of catastrophic consequences in the environment of and in the above ground area of the well in which there is a breakdown of the electric feedthrough system, particularly where the well is an oil and/or gas well and any fire resulting may spread throughout the well field. The problems stated are compounded by the usual practice of having a plug in joint in the electrical feedthrough systems for its connection to the lower cable which is spliced to that portion of the cable system originally connected to the pumping equipment to be powered. The plug in joint is located in the region where there may be aggressive, deadly fluids under pressure. This joint has been the "weakest link" in current designs.

The improvements of the present invention substantially obviate the above mentioned problems and enable a much greater degree of safety in the operation of electrically powered equipment in the environment of fluids of a highly volatile or dangerous character and subject to conditions of high pressures and temperatures which are variable in character and wherein portions of the electrical feedthrough systems supplying the necessary power are by reason of the location thereof subject to substantial differentials of temperature and pressure.

The inventor believes the general and current state of the art pertinent to the area of the present invention is represented by the disclosure of the following U.S. Letters Patent, namely: No. 4,154,302, May 15, 1979, Edward T. Cugini; No. 4,041,240, Aug. 9, 1977, Alexander D. Sipowicz; No. 3,437,149, Apr. 8, 1969, E. T. Cugini et al.

The inventor is not aware, however, of any prior art which is specifically pertinent to the improvements of the present invention as herein set forth and specifically claimed.

SUMMARY OF THE INVENTION

The present invention provides an electric feedthrough unit for application to a wellhead or the like to serve as a device for connecting underground equipment with an above ground source of electrical power.

Embodiments basically comprise a primary insulator which is a rigid, and, preferably, generally cylindrically shaped body of insulating material such as an alumina ceramic, for example, having a high, consistent and predictable dielectric strength and provided with three longitudinally extending coextensive bores which are in a parallel spaced relation to each other and to its longitudinal axis. An electrically conductive copper rod is positioned in each bore, intermediately of and spaced from its respective ends. These copper rods are respectively extended, at one end, by the three wires of an armored electric cable, at one end of which end portions of the wires, stripped of their armored casing and separated, have their extremities stripped of their individual sheathing, bared and fixedly connected, respectively, to the copper rods.

In the assembly of the electric feedthrough unit, the insulator, including those elements then contained therein, is slip fit into a protective sleeve which is open to each of its opposite ends. This sleeve is preferably provided by a steel tube and the insulator is established in bearing relation to its inner wall surface at a location wherein it is intermediately of and in spaced relation to its respective ends.

In the application of the electric feedthrough unit to a wellhead, the protective outer sleeve is projected therethrough and connected therewith to provide that only a short portion of its length including what then constitutes its upper open end is projected upwardly of the head and exposed to an above ground environment. At the same time the major portion of the longitudinal extent of the sleeve, including its contents, is set to extend vertically from and below the head, into the environment of the well which it caps. In order that the nature and character of the invention and its application be best understood, the relation of the parts of its embodiments will be hereinafter particularly described in this frame of reference.

In preferred embodiments, the inner surface of the protective sleeve and the outer surface of the insulator body are so formed and dimensioned that as the insulator is slip fit within the sleeve by way of its open lower end a portion of the body thereof, at its outer periphery, comes into limiting abutment with a portion of the inner surface of the sleeve, thereby to determine the required position of the insulator. The protective sleeve is itself axially extended at its lower end by an overlapped interconnection therewith of the upper end of a clam shell shaped tubular fitting. This fitting extends downwardly of the sleeve, about and in spaced relation to individually sheathed portions of the wires the upper extremities of which have been bared and conencted to the copper rods, to overlap and sealingly interfit with and clamp to, about and circumferentially of the armored portion of the aforementioned cable immediately below the upper limit of its armor.

In most preferred embodiments of the invention the sheltered and recessed location of the copper rod in each bore of the insulator, which is inserted therein by way of its open lower end, is determined by means through which it is interrelated with a portion of the bonding wall surface of the bore, from which the outer peripheral surface of the body of the rod is radially spaced. An O-ring seal or its equivalent is provided circumferentially of each rod, at a location adjacent and spaced from its lower end, between its outer peripheral surface and the bounding wall surface. A similar seal is placed between the outer peripheral surface of the body of the insulator and the bounding inner wall surface of its protective sleeve, at a location relatively adjacent and spaced from the location of the O-ring seals which bridge the spaces between the copper rods and their respective bounding wall surfaces.

Particular attention is directed to the fact that the respective ends of each copper rod are well recessed within the length of the bores to which they apply and that their connections with the copper wires of the aforementioned length of electrical cable are likewise sheltered within the body of the insulator.

With the described essential elements of the electric feedthrough unit in place, space within and below the insulator body in the housing structure defined by the protective sleeve and its shaped tubular extension is filled with a substance which, as set, is a flexible dielectric material.

However, the upper ends of the bores of the insulator are only partially filled since the uppermost extremities of the copper rods therein are left bare and free for a conductive connection and interruption thereof with the wires of a length of cable connected to an above ground source of power.

A significant feature of the electric feedthrough unit of the invention is that no bonding is required as between the insulator body and its protective sleeve or as between the sleeve, the insulator body or the copper rods and any additional dielectric material applied therein or thereabout for potting. It is also significant that a homogenous, void free potted dielectric is not required for satisfactory performance of the unit. Most importantly, its construction and arrangement not only inhibits, to an ultimate degree, seepage of well fluids to the interior of its protective housing and dangerous arcing but also dictates that any stresses and strains applied to its interior parts are transferred to and accommodated by that portion of its housing provided by the protective sleeve. The net result is to preclude adverse relative displacement of its essential parts, prevent escape therethrough of toxic or flammable fluids to an above ground environment and to minimize and substantially eliminate the chance of blowout or fire resulting from a breakdown of the integrity of the electric feedthrough unit applied to a wellhead.

In cases where lead sheathing is required for the wires of the cable applied to form an integral part of an electric feedthrough unit of the present invention, the separated portions of the lead sheathed wires within the protective sleeve thereof are passed through the three apertures of a disc, of brass or, preferably, alumina ceramic, which is positioned within and bridges the interior of the sleeve immediately of the lower end of the insulator. The outer periphery of the disc bears against the inner wall surface of the sleeve and a ring seal which extends circumferentially of this disc is compressed therebetween. In the event the ceramic disc is used, the surfaces thereof which bound its apertures are metallized. In any case the lead sheathed wires are soldered to the disc and the solder seals the apertures through which the wires project. The disc so constructed and applied, and its encompassing seal, present a barrier which completely blocks fluids from passing thereby to the bores of the insulator body if for any unforeseen reason well fluids should enter the clam shell shaped tubular extension of the protective sleeve. Furthermore, if the disc should be subjected to any significant pressure, stress and/or strain directed thereto by way of the clam shell shaped tubular extension by reason of extremes of differential pressure to which the electric feedthrough unit may be subjected due to conditions within the well, the disc will transfer the same to the protective sleeve by way of the insulator body. An alternative construction may be provided by virtue of which the disc may be interengaged with a portion of the sleeve and thereby be in position to transfer any applied pressure, stress and/or strain directly to the protective sleeve. In any case a disc such as described will afford an impenetrable wall surface providing a complete backup seal across a lower end portion of the protective sleeve directly below the insulator body, thereby to insure the integrity of the electric feed through made possible and afforded by the present invention.

The construction of the electric feedthrough unit facilitates a simple, highly effective, weather proof telescopic interconnection with its protective sleeve of a pipe-like fitting housing one end of an above ground cable the wires of which are interconnected with and extended by copper bars portions of which project from and in leading relation to that end of the fitting which applies to the protective sleeve. The space within the fitting about the portions of the cable and the copper bars therein which extend its wires is filled with a flexible dielectric material such as an epoxy. The same material is extended to form a protective tapered sleeve about the projected end portion of each copper bar. The outer diameter of the pipe-like fitting at that end from which the copper bars project is sized so that in the application of the fitting it is telescopically inserted in the upper end of the protective sleeve of the electric feedthrough unit to have its outer surface in bearing relation to the inner wall surface of the sleeve as the projected ends of the copper bars which lead the same move into the upper ends of the bores of the insulator to couple with and conductively relate to the upper end portions of the copper rods which are recessed in the said bores. As will be seen, there is a simple plug fit interrelation of the pipe-like fitting to the protective sleeve as well as the copper bars to the copper rods embodied and contained within the bores of the insulator. The outer surface of the portion of the fitting which is telescopically interfit with the protective sleeve embodiments therein, and circumferentially thereof, a ring type seal which projects therefrom and sealingly engages with the inner surface of the upper end of the protective sleeve in the course of their interfit. At the same time, in the application and interconnection of the copper bars with the copper rods, the protective dielectric sheathing provided peripherally thereof forms a tight leak proof seal not only about projected ends of the copper bars but about those portions of the copper rods to which the bars are coupled. The preferred construction in this respect will be exemplified in the detailed description of preferred embodiments of the invention which follows.

The outer surface of the protective sleeve of the assembled electric feedthrough unit herein illustrated is provided with an external radially projected flange adjacent its lower end which couples to its tubular extension. In application of the feedthrough unit to a wellhead it is inserted in and projected through the tubular hanger portion thereof, in the process of which said external flange is caused to abut the lower end of the hanger. A nut-like device utilized to couple the upper end of the protective sleeve with the applied fitting, once they are telescopically interfit, bears on the upper end of the hanger as it is threadedly engaged to the sleeve. The result of this is to draw the external flange of the sleeve into a clamped relation to the lower end of the hanger. This fixes the electric feedthrough unit to be hanger and thereby to the wellhead in the position and orientation above described.

It is accordingly a primary object of the invention to provide a new and improved electric feedthrough unit for application to a wellhead which is economical to fabricate, more efficient and satisfactory and safer in use, adaptable to a variety of applications and unlikely to malfunction.

Another object is to provide a simply constructed electric feedthrough unit for application to a wellhead having a structural integrity which makes it hightly resistant to breakdown under the influence of the extreme differentials of pressures, voltages, and temperature prevalent at the head of a well and particularly so to infiltration and passage therethrough of destructive and dangerous well fluids.

An additional object is to provide an electric feedthrough unit for application to a wellhead characterized by the essential parts thereof being assembled in the first instance by a slip fit application of one thereof to the other and without a requirement of bonding of one to the other.

Another object is to provide an electric feedthrough unit for application to a wellhead distinguished by lack of vulnerable joints the length thereof.

A further object is to provide an electric feedthrough unit wherein the essential conductive connector elements thereof are protectively recessed and housed in a rigid body of insulating material which itself is simply fit in a bearing relation to and recessed within a protective sleeve-like housing.

Ad additional object of the invention is to provide an electric feedthrough unit wherein the essential components thereof are so interrelated and housed that essentially all the stresses and strains applied to the unit in use thereof are directed to and dispersed through its housing structure per se.

A further object is to provide an electric feedthrough unit wherein the conductive connector elements thereof and the connections which they are required to make the wires of interrelated cables are contained and isolated from one another within the bores of a rigid body of insulation fit in bearing relation to a protective sleeve structure to provide a construction and arrangement which in use of the electric feedthrough unit substantially precludes the occurrence of dangerous short circuiting or arcing.

An additional object of the invention is to provide an electric feedthrough unit and component parts thereof and a cable assembly for interconnecting below ground equipment with an above ground source of power possessing the advantageous structural features and parts thereof, their inherent meritorious characteristics and their means and mode of use such as exemplified by the embodiments herein described.

An additional object of the invention is to provide an electric feedthrough unit wherein if the top connector is unplugged without switching off the voltage supply, the arcing thereby produced as the conductors physically separate will self extinguish inside the unit and not ignite any combustible gases which may be present outside the unit.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein are shown some but not necessarily the only forms of embodiments of the present invention, FIG. 1 is a generally diagrammatic view illustrating an application of an electric feedthrough unit per the present invention to a wellhead;

Figure 1:
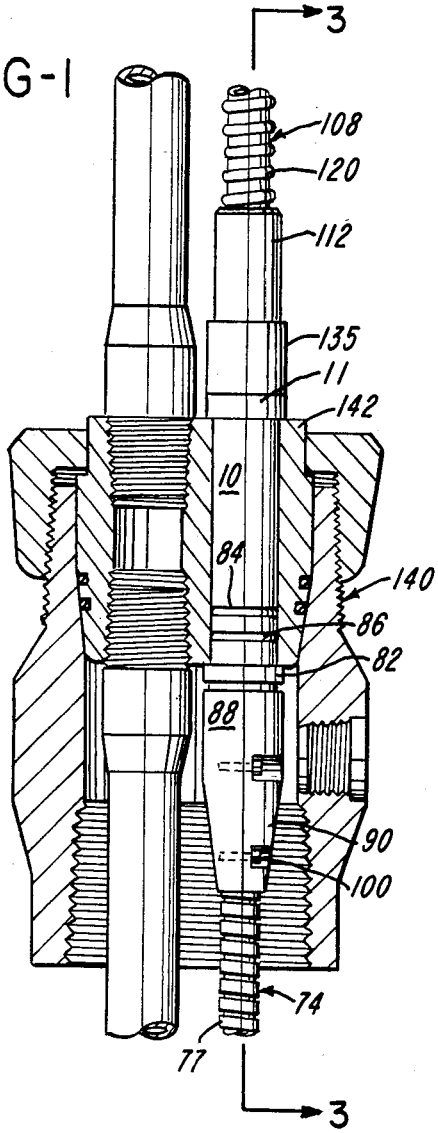
Figure 4:
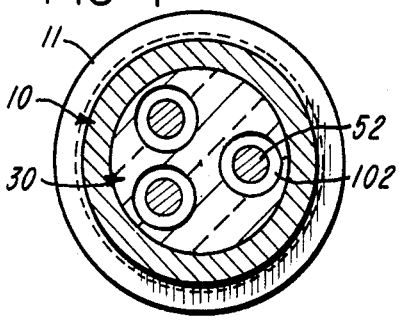
Figure 5:
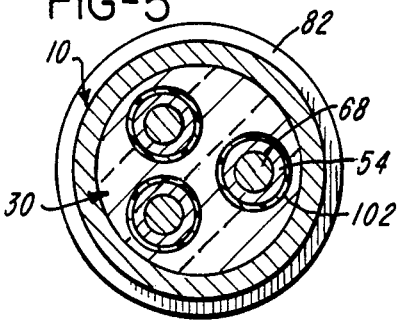
Figure 6:
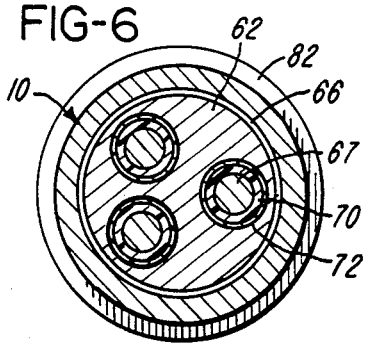
Figure 7:
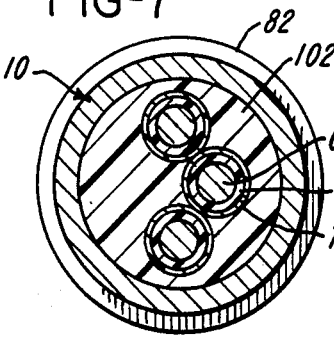
Figure 8:
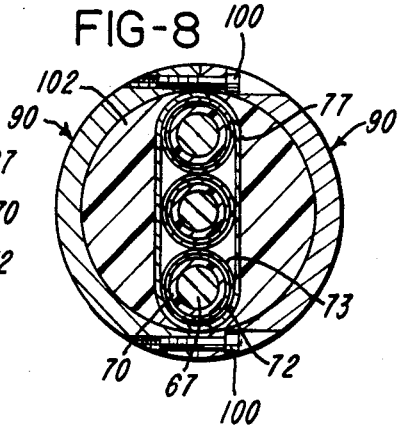
Figure 9:
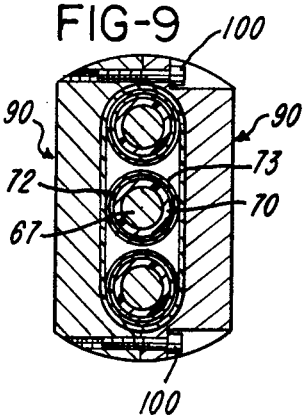
Figure 2:
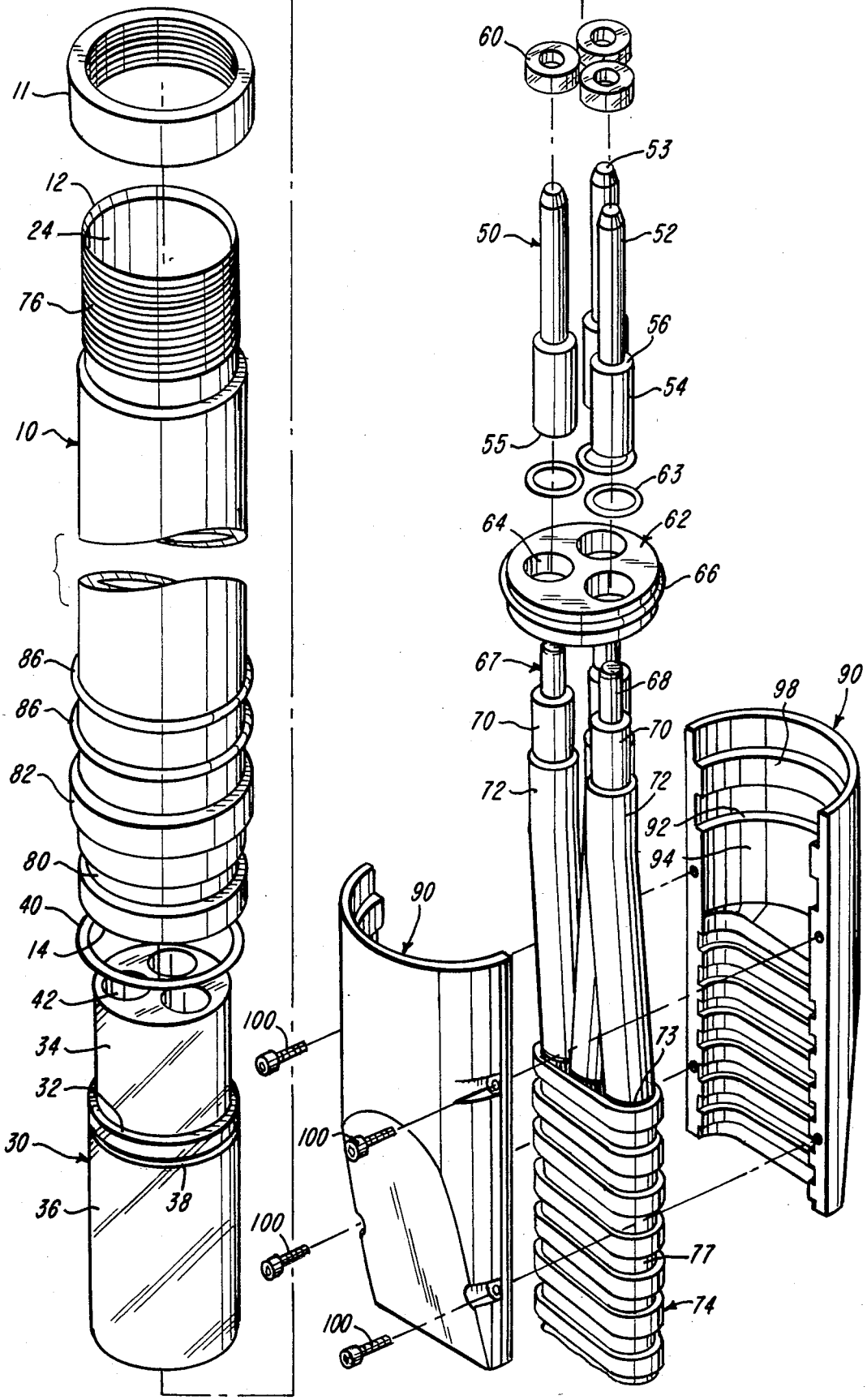
FIG. 2 is an exploded view of one embodiment of the invention demonstrating component parts and the ease of their interfit and assembly.
Figure 3:
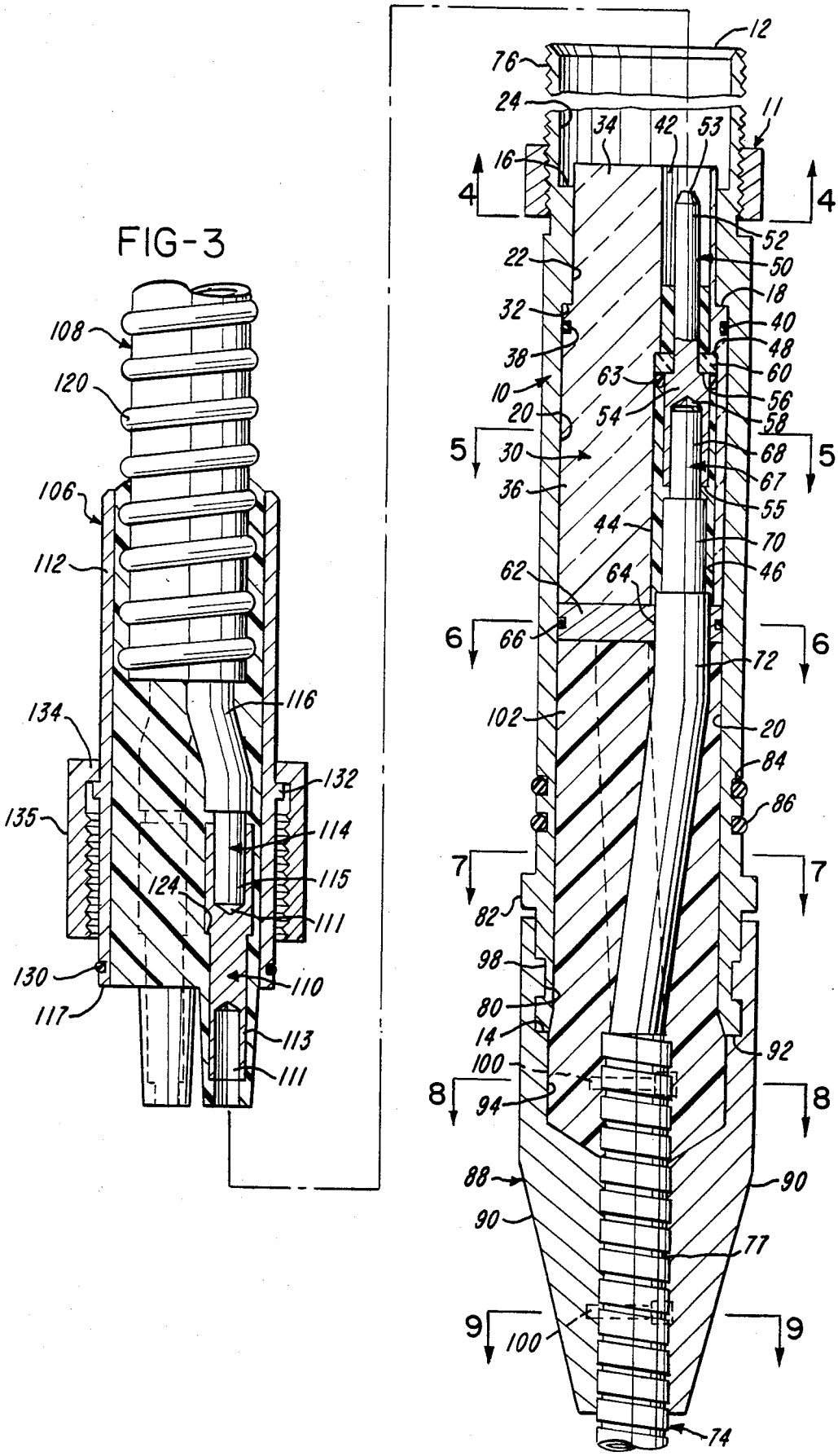
FIG. 3 is an illustration of the electric feedthrough unit of FIG. 2 shown in longitudinal section assembled by means of an advantageous fitting with one end of a cable utilized for interconnecting the unit with a source of power.
Figure 11:
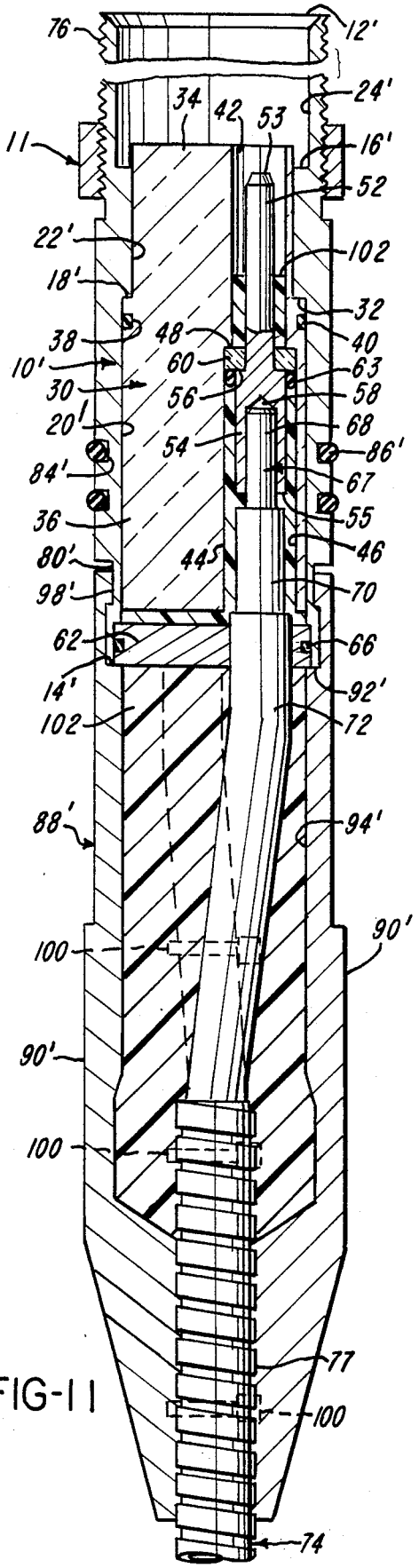
Figure 10:
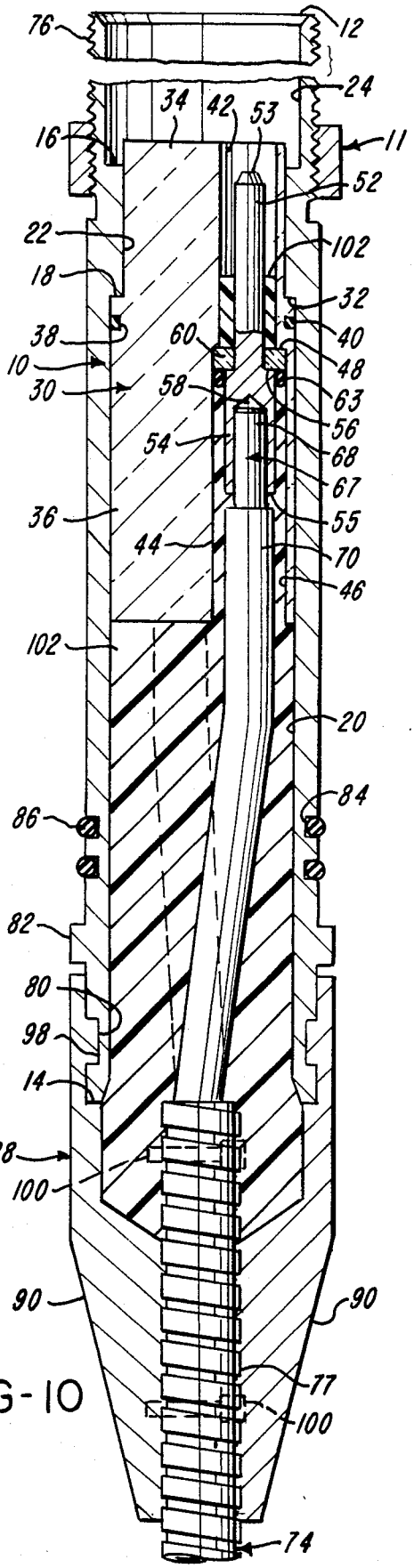
Figure 12:
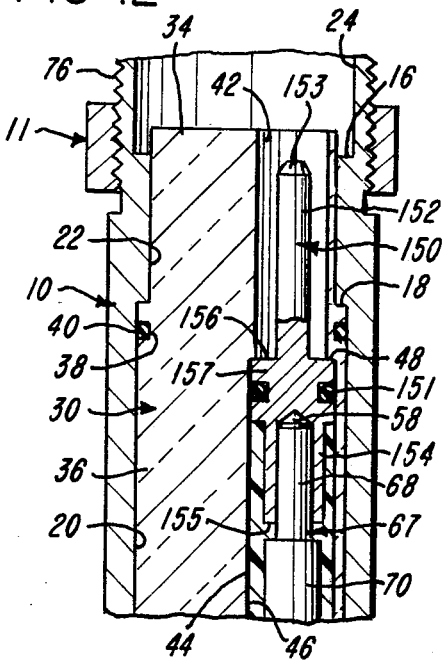

FIGS. 4, 5, 6, 7, 8 and 9 are sectional views referenced to the electric infeed unit demonstrated in FIGS. 2 and 3, taken respectively along section lines 4—4; 5—5; 6—6; 7—7; 8—8; and 9—9 of FIG. 3;

FIG. 10 is a sectional view illustrating a first modification of the electric feedthrough unit of FIG. 3;

FIG. 11 is a sectional view illustrating a second modification of the electric feedthrough unit of FIG. 3;

FIG. 12 shows a third modification of the embodiment of FIG. 3; and

Figure 13:
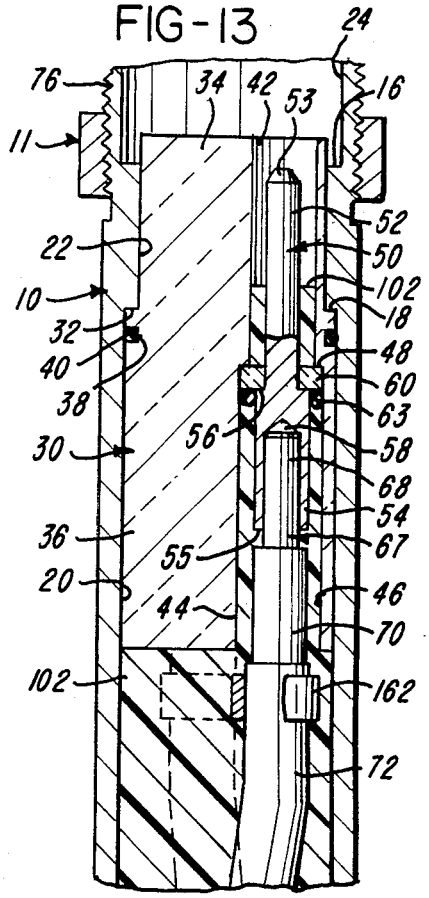

FIG. 13 shows yet a further modification of FIG. 3.

Like parts are indicated by similar characters of reference throughout the several views.

Referring to FIGS. 1-9, the electric feedthrough unit therein illustrated comprises a steel tube providing a sleeve 10 open to each of its opposite ends 12 and 14.

The inner surface of this sleeve is stepped to form thereon parallel, longitudinally spaced, radially directed, shoulders 16 and 18 which divide the length thereof into three distinct sections 20, 22 and 24. The section 20 extends between the end 14 and the shoulder 18, bounds the major portion of the longitudinal extent of the bore of the sleeve and within its limits provides the bore with a diameter which is uniform except at a point immediately of the end 14 where it has a slight outward flare. The section 22 lies between the shoulders 16 and 18, is relatively short in length and bounds a portion of the bore the diameter of which is also uniform but somewhat smaller in dimension than that of that portion of the bore bounded by the wall section 20. The length of the remaining section 24, which lies between the shoulder 16 and the end 12, is slightly greater than that of the section 22 and while that portion of the bore which it bounds has a diameter which is uniform, its dimension is greater than that of the diameters of those portions of the bore respectively bounded by the wall sections 20 and 22. The shoulder 18 is relatively narrow and faces outwardly of and is, as indicated previously, in a substantially spaced parallel relation to the end 14. The shoulder 16 is somewhat broader than the shoulder 18, in a relatively adjacent, spaced parallel relation to and faces outwardly of the end 12.

In the application of the sleeve 10 and the electric feedthrough unit of which it forms a part to a wellhead which caps an oil well, as shown, a short portion of the length of the sleeve, from its end 12 to and slightly beyond the location of the shoulder 16, is projected substantially perpendicular to and upwardly from the wellhead and exposed thereby to an above ground environment. The remainder and substantially greater portion of the longitudinal extent of the sleeve is projected through and depends vertically from the wellhead and into the environment of the well which it caps. Sleeve 10 is thus vertically oriented and a portion of its longitudinal extent including its end 14 is within the well.

A rigid generally cylindrical insulator 30 fit within the sleeve 10 intermediate its ends is formed or molded of a strong material having a high dielectric strength, such as an alumina ceramic or its physical equivalent. As shown in the drawings, the insulator 30 is a generally elongate solid body the outer peripheral surface of which is stepped and configured to produce thereon an annular radially directed shoulder 32. The shoulder 32 is parallel to the end surfaces of the insulator and defines a plane of demarcation between one end portion 34 thereof which is relatively short in length and its remaining portion 36 the longitudinal extent of which is substantially greater. As will be seen from FIG. 3, the diameter of the end portion 34 is complementary to that of the portion of the bore of the sleeve 10 bounded by section 22 of its inner wall surface. At the same time the longitudinal extent of the end portion 34 is somewhat greater than that of the wall section 22. The diameter of the portion 36 of the insulator is, on the other hand, complementary to that of the portion of the bore of the sleeve 10 bounded by the wall section 20.

The shape and dimension of the insulator 30 so defined enables it to be slip fit within the sleeve 10 by way of its lower end 14 to bring the shoulder 32 into a coextensive limiting abutment to its shoulder 18. This establishes the insulator in its required position intermediately of and spaced from the respective ends of the sleeve. With the insulator so set the longitudinal extent of the outer peripheral surface of its portion 36 bears directly on the bounding portion of the wall section 20. At the same time the outer peripheral surface of the end portion 34 bears on the wall section 22 and has its projected extremity slightly beyond the shoulder 16 and positioned in a concentric spaced relation to the bounding portion of the section 24 of the inner wall surface of the sleeve 10. An annular groove 38 is formed in and circumferentially of the outer peripheral surface of the portion 36 of the insulator 30 at a location adjacent and spaced from the shoulder 32, below the shoulder 18 which it abuts. The groove 38 nests, in part, a resilient O-ring seal 40 which prior to the application of the insulator in the sleeve 10 projects outwardly therefrom. In the slip fit application of the insulator to and the positioning thereof within the sleeve 10, the O-ring 40 is compressed and forms a seal between the insulator and the bounding portion of the inner wall surface of the sleeve.

The body of the insulator is provided with three longitudinally directed coextensive bores 42 which are in a parallel, spaced relation to each other and to its longitudinal axis. Each bore has an identical counterbore 44 directed inwardly thereof from its lowermost end to extend more than one half its length. Each counterbore 44 is bounded, the length thereof, by a coextensive wall surface 46 and forms inwardly of the bore 42, to which it applies, an annular radially directed shoulder 48. The outer radial limit of the shoulder 48 is bounded by and merges with the inner limit of the wall 46 and its inner radial limit bounds one end of and has a diameter corresponding to that of the portion of the original bore 42 which remains subsequent to the application thereto of its counterbore 44.

An elongate electrically conductive copper element 50 is housed in each bore 42, 44 to position therein longitudinally thereof, in spaced relation to its respective ends and in a radially spaced relation to its bounding wall surface. The major portion 52 of the longitudinal extent of each element 50, including one end 53 thereof, has a rod-like form which is uniform in cross section except for a very short portion of its length including its end 53 where it is convergently tapered, thereby to provide that the end 53 exhibits its minimum cross sectional dimension. The remaining portion 54 of the length of each element 50, including its opposite end 55, also has a rod-like form but the dimension thereof in cross section, at its outer periphery, which dimension is uniform the length thereof, is greater than the corresponding dimension of the portion 52 at its maximum. As a result thereof, the outer peripheral surface of each element 50 is provided with a radially directed annular shoulder 56 at the juncture of the portions 52 and 54. The inner radial limit of the shoulder 56 bounds and merges with the inner end of the portion 52 and its outer radial limit merges with the outer peripheral edge of the inner end of the portion 54. The shoulder 56 so defined is in a plane which extends transversely of and at a right angle to the longitudinal axis of the element 50 in each case.

The portion 54 of each element 50 so defined has a blind bore 58 directed inwardly thereof and coaxial therewith from its end 55 to extend for a major portion of its axial length.

The shape and configuration of each copper element 50 serves to provide it with a male connector part at one end which is uppermost and a female connector part at its opposite end which is lowermost, having reference to the orientation and application thereof herein illustrated and described.

Prior to the application of each copper element 50 in a bore of the insulator 30, by way of its counterbore 44, an annular disc 60 of material having a high dielectric strength, such as an alumina ceramic, is slipped over the male connector portion 52 thereof to seat thereabout with one face in abutted relation to the shoulder 56. The radial extent of the annular disc 60 provides that its inner radial limit bears on the outer periphery of the part 52 immediately of the shoulder 56 and its outer radial limit projects outwardly thereof and beyond the outer peripheral limit of the part 54. The dimension and configuration of the disc 60 provides that, as each element 50, with a disc 60 applied thereto, is inserted in a bore 42 by way of its counterbore, the radially outermost peripheral surface of the disc bears on the wall surface 46 and its bearing relation thereto is maintained as an outer peripheral portion of the leading face thereof is abutted to and coextensively with the shoulder 48. With a disc 60 so seated, its radially projected portion, at the face thereof remote from the shoulder 48, is backed and sealingly and coextensively abutted by a resilient O-ring 63. The O-ring 63 bridges and forms a seal about the upper end portion of the part 54 of the interrelated element 50, between it and the bounding portion of the wall surface 46. As can be readily seen, each O-ring 63 serves as a medium to preclude the passage of fluid thereby and past the disc 60 and shoulder 48 to the upper end of the bore 42 in which it has been assembled.

Take particular note of the fact that the level of the O-rings 63 is in a closely spaced relation to the level of the seal 40 which has been provided between the insulator 30 and the bounding portion of the inner wall surface of the sleeve 10 on their assembly. Take note also of the fact that the centerline of the copper conductor bar 52 is held on the axis of the bore 42 by the disc 60 and O-ring 63, as described, and the radial relation of the bores 42 is established when they are machined in the insulator.

In the assembled condition of the embodiment of FIGS. 1–9 the lowermost end of the insulator 30 is backed and substantially coextensively abutted by a brass disc 62 which embodies therein three apertures 64. The apertures 64, which are in a substantially parallel spaced relation are so disposed as to respectively position coaxially with and form an extension of one of the bores 42, 44. The outer peripheral surface of the disc 62, which essentially bears on the inner wall surface of the sleeve 10, embodies therein a circumferentially extending groove nesting, in part, a resilient O-ring 66. When brass disc 62 is set in its required position the O-ring 66 is compressed and forms a seal between its peripheral surface and the bounding portion of the inner wall surface of the sleeve 10. The disc 62, once set, retains the O-ring in place.

Viewing the assembled electric feedthrough unit of FIG. 3, it will be there seen that each rod-like copper element 50 has an end portion 68 of a copper wire 67, which is otherwise sheathed the length thereof, fit in its blind bore 58 at its lowermost end. The wire 67 is soldered or otherwise fixed to the element 50 to which it applies by virtue of which to form an electrically conductive extension thereof. Except for its end portion which is inserted in and slightly projects from the element 50 to which it applies, each wire 67 is sheathed the length thereof. In the embodiment of FIGS. 1–9, each wire 67 is triply sheathed. The inner sheath is provided by a layer 70 of an insulating material such as ethylene propylene the length thereof except for that bared end portion applied in and connected to the copper element 50. The intermediate sheathing, in the case here illustrated, is essentially a lead sheath 72. The sheath 72, as shown, extends coextensively with and about the sheath 70, from the end thereof most remote from the element 50, to which the contained wire applies, to a point short of and spaced to a greater extent from the element 50 than the adjacent relatively spaced end of the sheath 70. By virtue of this arrangement, the spacing between the element 50 and the most adjacent end of the lead sheath 72 is such to preclude an interaction therebetween or between the lead sheath and the wire 67. The outer sheath 73, which covers the length of the lead sheath, is provided by a sleeve of laquered braid. This braid is stripped from a short portion of the length of the lead sheathing including its end which is adjacent the projected end portion 68 of its contained wire, for purposes which will be obvious from the following description.

Prior to the application of the wires 67 to the elements 50 and prior to the placement of disc 62 in the sleeve 10, as previously described, the bared end portions 68 of the wires are projected through and beyond the apertures 64 of the disc sufficiently to cause the adjacent end portions of the lead sheathing (stripped of the sheath 73) to locate within and slightly beyond these apertures. The apertures 64 are sized in the first instance to have the diameter thereof complementary to the outer diameter of the lead sheathing. When the bared end portions 68 of the wires are then inserted in the blind bores 58 of the elements 50 and therein fixed, the disc 62 is appropriately placed in its required position with reference to the wires by the interconnection thereof to the sheathing 72 by solder applied at each aperture 64. This solder not only seals the apertures 64 but connects the sheathed wires in a fixed relation to the disc.

The three sheathed wires 67 form part of and provide the electrically conductive elements of a length of armored cable 74 wherein they are peripherally encased by an external armor 77 of interlocked galvanized steel or monel. As will be obvious from FIG. 3, the encasing armor 77 is stripped from a short portion of one end of the cable to expose the respective end portions of the sheathed wires 67 within that end thereof so they may be separated and modified as to their sheathing to enable the bared end portions 68 to be inserted in and connected to the rod-like elements 50. With the appropriately stripped end portions of the wires projected through the apertures of the disc 62 and their lead sheathing fixed in connection therewith by soldering and their upper end portions 68 connected to the elements 50, viewing the cross section of FIG. 3, the cable of which they form a part will vertically depend from the body of the insulator, to and through the disc 62 and through and from the lower end of the sleeve 10 as the electric feedthrough unit in which they are assembled is installed in connection with a wellhead.

The outer peripheral surface of the sleeve 10 is generally uniform as to its diameter except for the following deviations.

a. The end portion 76 thereof which is uppermost and projected above the wellhead to which it applies is threaded and threadedly engaged by a ring-shaped nut 11, the internal surface of which is formed to have a complementary thread;

b. A circumferential groove 80 is provided adjacent and spaced from its lowermost end;

c. An external, radially directed ring-like projection 82 is provided thereon at a location above and in a parallel relatively closely spaced relation to the groove 80; and d. A pair of narrow grooves 84 which are in a closely adjacent longitudinally spaced relation are formed therein above the level of and parallel to the projection 82 and its upper and lower faces. Each groove 84 nests, in part, a resilient O-ring 86 the outer peripheral portion of which projects radially outward of the outer surface of the sleeve 10.

From a point adjacent the lower end 14 of the sleeve 10, and throughout the remainder of the length thereof as they depend therefrom, the three lead sheathed wires 67 are each encased in a braided sleeve 73 and they are all clad with and encased by an outer layer of protective armor 77 to form a flat package thereof wherein they are disposed in a side-by-side relation. This package diametrically, transversely and fully bridges the interior of the layer of protective armor lending strength thereto.

The armor 77 is so fabricated that its outer surface is grooved.

A portion of the length of the cable 74, at the upper end thereof immediately below the sleeve 10, extends through and is contained within a tubular clam shell type fitting 88. The fitting 88 is formed of two longitudinally extending, identically shaped, halves 90 which are fabricated of a strong pressure and temperature resistant metal such as steel or its equivalent. The upper end portion of the fitting 88 is mounted in an overlapped and snugly fit relation to and about the outer peripheral surface of the lower end portion of the sleeve 10, from its end 14 to a level immediately of and below the ring-shaped projection 82.

For a short portion of its length, commencing immediately below the sleeve 10, the fitting 88 is reduced as to its interior cross section to produce an inwardly directed radial shoulder 92 on its inner surface which in the assembly of the fitting abuts the surface defining the end 14 of the sleeve. Immediately below the end 14 a short portion 94 of the length of the inner wall surface of the fitting 88 is formed on a uniform radius which corresponds to that of the inner surface of the sleeve immediately at its end 14. Accordingly, the portion 94 effectively provides a coaxial extension of the interior of the sleeve 10.

Immediately following and below the portion 94 the interior wall surface of the fitting is convergently tapered for a very short portion of its length. Thereafter it is uniformly formed to be complementary in shape to and to tightly and closely interfit with the outer peripheral surface of the armor of the cable 74.

In that portion of the fitting 88 which overlaps the lower end of the sleeve 10, the opposed inner surfaces of its halves 90 are formed to incorporate mating portions of a ring-shaped projection 98 directed radially inward thereof. As the upper ends of the two halves of the fitting are brought together about the lower end of the sleeve, the mating portions of the projection 98 nest in, extend circumferentially of and firmly fit to, and about the base of the groove 80. Simultaneously therewith facing planar side edge portions which extend the length of the halves 90 interfit and define a seal therebetween as they are clamped together by bolts 100 and the facing lowermost end portions of the halves 90 tightly clamp to and about the portion of the cable 74 which extends therethrough to produce a male-female interfit thereof and a seal therebetween.

As thus applied, the fitting 88 not only rigidly connects with and forms a coaxial extension of the sleeve 10 but supports the cable 74 in a fixed dependent relation thereto, thereby to relieve the stress and strain therein that would otherwise exist. The effect of such support is to provide an underlying supplemental support for those sheathed wires 67 which rise upwardly of the interior of the fitting 88, to the disc 62 and subsequently to the elements 50.

Once the various essential components of the electric feedthrough unit are set in their required positions within the sleeve 10 (FIG. 3), the spaces which then remain within the housing structure 10, 88 are filled or have introduced therein a dielectric material such as an epoxy 102 which is relatively flexible when cured. The portion of the dielectric 102 which underlies the disc 62 provides therefor a supplemental, underlying barrier and backing support. It also serves as an added pressure and temperature disseminating medium. It is noted, however, that though its inclusion is preferred the presence of this dielectric below the disc 62 is not absolutely essential. The electric feedthrough unit of the invention will still be capable of fully functioning, in its absence, over a long period of time while continuing to exhibit the very high factor of safety inherent in its use for the purpose described. That is to say that even without the dielectric material 102 there will be no electrical or fluid leakage therein or therefrom and neither a mechanical or an electrical failure will result.

A most significant aspect of the embodiments of the invention is the simple nature of their components and the ease of their assembly, interconnection and interfit. Moreover, with the construction herein described there is no dependency or requirements for its integrity that there be perfect bonding or for that matter any substantial bonding as between its component parts and substances or that there be perfect homogeneity of any injected dielectric material. Furthermore, the arrangement of its respective parts provides an isolation of its electrically conductive copper elements 50 (and the connections thereto) which affords maximum deterrence to and substantially an elimination of arcing and it also makes its extremely difficult for short circuiting to occur. The use, moreover, of a rigid body of insulating material to contain and shelter the elements 50 and their connections and as a medium through which to channel internally applied stress and strain to the exceedingly strong, sealed, housing structure of the invention embodiments, particularly in the manner herein described, renders it highly unlikely that they would experience a breakdown or malfunction or be seriously or adversely affected in any way in their operation.

A benefit incidental to the use of the dielectric 102 is that its embeds and further supports the sheathed wires which extend through the fitting 88, the housing 10, to the elements 50. This provides a measure of additional insurance that their connections will be preserved in the operation of the electric infeed unit of which it forms a part.

An important aspect of the use of the clam shell type fitting 88 to provide an extension of the sleeve 10 is that it effectively provides an optimally sealing male-female interconnection thereof to the structure related thereto at each of its opposite ends and a positive seal of that portion of the electric feedthrough unit which is exposed to the interior environment of the well to which it applies.

It is also pointed out that the flat packaging of the wires of the cable 74 as confined within the fitting 88 provides yet another factor which lends strength and durability to the invention embodiments.

A further and most important benefit of an invention embodiment is that its lower end which is to be exposed to the environment of a well is distinguished by the total absence of a plug-in joint for a cable. This eliminates a most vulnerable aspect of prior art units designed for application thereof to a wellhead.

It is noted that the disc 62 will be made of a material such as an alumina ceramic rather than brass where additional dielectric strength is desired. In such case the wall surfaces which bound the apertures 64 of the disc would be metallized to enable the soldering of lead sheathed wires thereto.

Each element 50 will preferably be coated with a dielectric medium, for example porcelain, epoxy or plastic, except for its male and female portions by means of which it is required to conductively relate not only to a wire of the cable 74 but also to a conductor element through the medium of which it will conductively relate to a wire of an above ground cable.

A point having further significance is that as contrasted to similarly applied devices of the prior art the devices of the present invention have an extremely high level of resistance to pressure and are quite unlikely to experience a catastrophic failure in their use.

The electric feedthrough unit of FIGS. 1–9 requires only an assembly of an above ground connector unit 106 to complete the system of which it forms a part. The embodiment of such a device (FIG. 3) comprises a length of a cable 108, three rod-like copper bars 110, each of the opposite ends of which has a coaxial blind bore 111, and a steel tube 112.

The cable 108 comprises three conductors (copper wires) 114 each sheathed by a layer 116 of insulating material such as ethylene propylene which is sheathed by a braided lacquered sleeve such as the sleeve 73. These three sheathed conductors are peripherally and tightly encased, the length thereof, in a metal armor sheathing 120. At one end of the cable 108 the corresponding ends of its conductors 114 are adapted for connection thereof to a source of electrical energy, in this case an above ground source. A short portion of the length of the cable including its projected extremity at the other end thereof has the armor sheathing and braided sleeve portions thereof removed to expose the sheathed end portions of the conductors 114 contained therein, the projected extremities 115 of which are bared by the removal therefrom of the insulating sheathing 116. The copper bars 110 are each applied respectively over one of the bared end portions 115 of one of the three conductors to receive the same in the blind bore 111 in one end thereof and create therebetween a male-female interfit. The so-coupled parts are interconnected by soldering or other suitable attachment means.

The free end portion 113 of each copper bar 110 is reduced as to its diameter with respect to its opposite end portion to define therebetween a radially directed shoulder 124 on its outer periphery which faces in the direction of its free extremity. The length of that portion of each bar 110 which is so reduced as to its diameter is greater than that of its larger diameter portion.

In the assembly of the connector unit 106 the end portions 115 of the conductors of the cable 108 are positioned within the bore of the tube 112 in an adjacent spaced relation to its end 117 which is remote from that end into which the cable is first introduced. The positions of the end portions 115 are so set that the reduced diameter portions of the copper bars 110 which form direct extensions thereof are equally projected, in part, from the end 117. This arrangement is such that the portion of each bar 110 which includes its shoulder 124 is located within the tube and recessed relative its end 117. The relative positions and spacing of the projected end portions of the bars 110 correspond in pattern to that of the locations of the bores 42 with reference to the body of the insulator 30 in which they are formed. When the components of the connector unit 106 are relatively positioned as described, the tube 112 is filled with a dielectric such as an epoxy which, when cured, serves as a potting substance to maintain their respective positions. This epoxy is extended outwardly of the end 117 of the tube 112, but only to the extent to form a convergently tapered sleeve about and slightly beyond the projected end portion of each copper bar 110 in a manner to produce an elongation of its blind bore 111.

The outer surface of the tube 112 is formed with a circumferentially extending groove, immediately adjacent its end 117, which nests therein, in part, a resilient O-ring 130 the outer peripheral portion of which projects radially from and outwardly thereof. It also embodies a radially directed ring-like projection formed integral therewith. The projection 132 is relatively adjacent but spaced more substantially from the end 117 than the O-ring 130. An internal flange 134 at one end of a sleeve-like nut 135 abutted to the face of the projection 132 remote from the end 117 of the tube 112 has its radially innermost surface in bearing relation to the outer peripheral surface of the tube as the cylindrical body of the nut extends about and beyond the projection in a closely spaced concentric relation to the tube and in the direction of its end 117. Beyond the projection 132 the inner wall surface of the nut is formed with a screw thread the form of which is complementary to and adapted for threaded engagement with the external thread on the outer surface portion 76 of the sleeve 10. Note that the end of the sleeve-like nut 135 remote from its flange 134 terminates short of and in a spaced relation to the location of the O ring 130.

The above ground connector unit 106 thus comprises a pipe-like fitting the outer dimension of which from its end 117 to its ring-like projection 132 is uniform in size to telescopically interfit within and to the upper end portion of the sleeve 10 bounded by the section 24 of its inner wall surface. The application of this connector will be further described.

In the example illustrated in FIGS. 1–9, the electric feedthrough unit of the invention will have been mounted to and in connection with a wellhead prior to the application thereto of the device 106. Shown diagramatically in FIG. 1, a wellhead 140 is illustrated which is inclusive of a vertically oriented hanger 142. The bore of this hanger is uniform as to its cross section and the basic outer configuration and the diameter of the sleeve 10 complementary thereto. Accordingly, the electric feedthrough unit of the invention herein described will, for its assembly to the wellhead, be inserted in the hanger by way of the end thereof which disposes inwardly of the well which is capped by the head of which it forms a part. In the application of the electric feedthrough unit the end 12 of the sleeve 10 serves as its leading end. As the sleeve 10 is advanced through the bore of the hanger its outer peripheral surface bears on its bounding wall surface. The movement of the electric feedthrough unit relative the hanger is limited by the engagement of its radial projection 82 with the end portion of the hanger which bounds the entrance to its bore. At this point the sleeve 10 is projected through and beyond the opposite end of the hanger to the extent of the length of the externally threaded end portion 76 of its outer surface. A sleeve-like nut 11 is then applied about and threadedly engaged to the section 76 of the outer surface of the sleeve 10 and moved inwardly thereof until it abuts and clamps to the upper end surface of the hanger 142. The result of this is to draw the ring-like projection 82 of the sleeve into a clamped engagement thereof to the lower end of the hanger, which is within the environment of the well to which the head 140 applies. The electric feedthrough unit is thereby fixed in place with reference to the wellhead and as so fixed the O-rings 86 are compressed and form seals between the sleeve 10 and the bounding wall surface adjacent the projection 82.

As will be seen from FIG. 3, the lowermost end portion of the sleeve 10, the upper limit of which is the projection 82, and the fitting 88 which forms a coaxial extension thereof constitute and house that portion of the electric feedthrough unit which is specifically exposed to the environment of the interior of the well adjacent the wellhead. At the same time, the uppermost end of the electric feedthrough unit, within the limits of the vertical extent of the section 76 of the sleeve 10, is exposed to an above ground environment.

It is at this point that the connector unit 106 is applied to cap the electric feedthrough unit, more particularly the end portion of its sleeve 10 including the threaded section 76 of its outer surface. As the unit 106 is advanced for this purpose, its leading end is defined by its end portion 117 from which project, in advance thereof, the outer end portions of the bars 110 each of which is sheathed by a sleeve of the flexible dielectric material which is thinned as to its wall section so as to be convergently tapered to its outermost end. At the same time the bars 110 are respectively coaxially aligned with the bores 42 and the upper ends of the elements 50. By virtue of this alignment, the projected sheathed end portions of the bars 110 are then telescopically applied to and over the bare upper end portions of the elements 50, which are accommodated in the blind bores 111. By reason of the taper of the dielectric sheathing about and projected in advance of the projected end portions of the bars 110, when a fully telescoped relation of the bars 110 and the end portions 52 of the elements 50 is achieved, the dielectric about the bars wedges to and mates with the dielectric inwardly of the bared end portions of the elements 50. Consequently the dielectric completely fills and provides a seal of the bores 42 about the connections so defined which conductively interrelate the bars 110 and the elements 50. Substantially concurrently a leading end portion of the tube 112 is directed to and through the end 12 of the sleeve 10 to tightly and telescopically fit within and to the section 24 of its inner wall surface. As there is a full fit as between the unit 106 and the electric feedthrough unit in the manner described, the O-ring 130 provides a complete seal between the outer surface of the tube 112 and the wall surface 24 adjacent the inner limit of the latter. There is effected, moreover, at this time, a tight contact between the bridging surface of the dielectric which fills the tube 112 at its end 117 and the upper end of the body of the insulator 30. In this fashion there is achieved, in a quick and simple manner, a weatherproof sealing interfit of the upper connector unit 106 to the electric feedthrough unit, providing thereby an electrically conductive interconnection of the wires of the cable 108, which are arranged for connection to an above ground source of power, to the conductors of the cable 74 which is an integrated part of the electric feedthrough unit.

It should be understood that before the electric feedthrough assembly 10, 88 is inserted in the hanger 142 and the nut 11 installed, the ends of the wires of the cable 74 which are remote from the conductor elements 50 are spliced to the wires of the cable coming from the downhole equipment which the electric feedthrough unit must service. In the illustrated application such equipment, for example, would be a pump submerged in the depths of an oil well to which the wellhead 140 is applied. Once the hanger is set in the wellhead, the unit 106 is installed, as previously described, to interconnect the wires of the cable 108 with the conductor elements 50. Lastly, the ring 135 is applied to the threaded end portion 76 of the sleeve 10 to thereby hold the upper connector unit to the sleeve 10 and the assembly of which the electric feedthrough unit is comprised.

It should be readily apparent from the foregoing that the electric feedthrough unit of the invention is an innovative structure devoid of any vulnerable plug-in joint within the well to which it applies. It is, moreover, a highly rugged structure wherein its electrically conductive elements which serve as connecting links between above and below ground cables are respectively structured and most protectively contained, within and in a substantially recessed relation to a rigid, solid, body of an insulator, which is also a dielectric, and in a manner to avoid and reduce to an absolute minimum and substantially eliminate the adverse effects normally experienced heretofore in application of an electric feedthrough unit of prior art to a wellhead.

The embodiments illustrated also provide an improved capsule enabling a system of the invention which is substantially invulnerable, both above and below ground level, to efforts of the environment or of well fluids to attack or deteriorate the same or the components thereof. The electric feedthrough capsule of the invention is clearly a multi-barriered and buffered structure as far as fluids reaching the elements 50 or for that matter seeping in or through the bores of the insulator 30.

One result of the use of the invention is to essentially eliminate extrusion influences on or destructive displacement of substances and elements interior to the embodiments of its electric feedthrough unit.

A further result is that when the upper plug is unplugged with the current on and arcing occurs as pins separate from sockets, a suitable frame path (of proper maximum clearance and minimum length) is provided to extinguish any flame before it can ignite gases external to the feedthrough unit.

The consequence of all the features and benefits aforementioned are to make it extremely difficult if not impossible to have arcing, short circuiting, blowout or the occurrence of fire in the use of the invention apparatus.

Various modifications of the embodiment of FIGS. 1–9 are shown in FIGS. 10–13 of the drawings. In the embodiment seen in FIG. 10, for example, the electric feedthrough unit thereof utilizes a cable 74 which is identical to that described with reference to FIGS. 1–9 with exception of the elimination therefrom of the lead sheathing 72. This is not the preferred embodiment, but as a consequence of this, the disc 62 and the seal 66 have also been eliminated. Otherwise, the electric feedthrough unit of FIG. 10 is identical to that of FIGS. 1–9. By virtue of the differences noted, in FIG. 10, the total interior of the housing structure 10, 88 below the body of the insulator 30 is filled with the flexible dielectric 102 to the point of a pressured bearing engagement thereof to the lower end of the insulator. At the same time the spaces in the counterbores 44 are also filled with the dielectric 102 to back the seals 63 and encase the larger diameter, lower portion of the rod-like conductors 50. The upper portions of the bores 42 are filled with the dielectric material 102 only to the limited extent shown and described with reference to FIG. 3.

In the case of the modification of FIG. 10, as is preferred with reference to the embodiment of FIGS. 1–9, the elements 50 are each coated, except for its male and female connecting surfaces, with a dielectric material such as a porcelain, epoxy or the like. This provides very high dielectric strength as the elements 50 are potted in the epoxy 102 enhanced substantially by the application of the ceramic disc 60. Again attention is directed to the manner in which the elements 50 are recessed within the body of insulating material. This effects a most important electrical isolation between these elements.

It will also be seen that, in the case of the embodiment of FIG. 10, the body of flexible dielectric 102 which underlies the insulator 30 serves, in the manner of a highly viscous fluid, as a barrier and buffer in advance thereof to distribute across its lower surface the forces and derivative stresses and strains applied to the lower end of the electric feedthrough unit as a result of its exposure to the environment of an oil well, as in the application referred to above by way of illustration.

The embodiment of FIG. 10 should be used where the purchaser's specifications preclude the use of lead sheathing for the conductors of the cable 74.

FIG. 13 illustrates the embodiment of FIGS. 1–9 modified by the elimination of the disc 62 and the O-ring 66. In lieu thereof a brass sleeve 162 is applied over and about and soldered to the lead sheathing 72 of each wire 67 adjacent its uppermost end. The joint between each sleeve 162 and the lead sheathing to which it applies is made pressure tight so no fluid can pass therebetween. In addition to the application of the brass sleeves the flexible dielectric 102 is extended to fill the void left by the removal of the disc 62 and the O-ring 66 to the extent to produce a pressured bearing engagement thereof to and across the lower surface of the insulator 30 and to the immediately surrounding wall surface of the sleeve 10. By virtue of this extension thereof the flexible dielectric 102 encases the brass sleeves 162 and the portions of lead sheathing 72 which they surround immediately below the lower surface of the insulator 30. Since the dielectric so applied adheres to the brass sleeves 162 and fully bridges the interior of the tubular housing 10 and fitting 88 below the insulator and encases the portions of the cable and its sheathed wires which extend therethrough, a barrier to passage of fluid is created across the sleeve 10 at the level of the brass sleeves immediately in advance of the insulator 30 and the entrances to its counterbores 44.

Note that flexible dielectric materials do not adhere well to ethylene propylene or lead, but brass solders readily to lead and the flexible dielectrics adhere readily to brass.

The modification of the embodiment of FIGS. 1–9 as shown in FIG. 13 is not preferred but it will be quite satisfactory for certain applications of the electric feedthrough units of the present invention.

FIG. 12 illustrates a modification of the embodiment of FIGS. 1–9 wherein electrically conductive elements 150, each per se mounting an O-ring 151, are substituted for the elements 50 and the annular ceramic discs 60 and O-rings 63 associated therewith.

The element 150, which is an integral structure, has one end portion 152 of rod-like form corresponding to that of the end portion 52 of the element 50 and its opposite end portion 154 enlarged as to its diameter with respect to that of the end portion 152 and provided with a blind bore 58 like the end portion 54 of the element 50. In this instance, however, a short portion of the axial length of the end portion 154, at that end thereof which joins the inner limit of the end portion 152, has its outer diameter uniformly enlarged to produce a circumferentially extending radial projection 157 on the body of the element 150. The projection 157 forms, at one end of its axial extent, an annular shoulder 156 which bounds the innermost limit of the end portion 152 and projects radially outward therefrom in a plane perpendicular to the longtitudinal axis of the element 150. A similar shoulder is likewise formed at the opposite end of the radial projection 157.

The diameter of the radially outermost limit of the projection 157 is complementary to that of the counterbore 44 of the insulator 30. Moreover, this projection has a circumferentially extending groove in its outer peripheral surface positioned between and spaced from its axial limits nesting, in part, a resilient O-ring 151 the outer peripheral portion of which projects.

Accordingly, when each element 150 is substituted for an element 50, it is applied to a bore 42 by way of its counterbore 44, using the projected extremity 153 of its end portion 152 as its leading end. As will be seen in FIG. 12, when the element 150 is fully inserted in the bore to which it applies, an outer peripheral surface portion of the shoulder 156 will firmly abut the shoulder 48 at the inner limit of the counterbore 44 and the outer peripheral surface of the radial projection 157 will bear on bounding wall surface 46 with the O-ring 151, then compressed, forming a complete seal therebetween. The extent of the projection of the end portion 152 beyond the shoulder 48, as determined by its length, will be the same as that provided for the end portion 52 of the element 50 in FIG. 3 and the remote end 155 of the element 150 will be positioned the same as end 55 of the element 50. Other than for the substitution described, the construction and arrangement of the embodiment of FIG. 12 will be the same as that of FIGS. 1–9, with the outer peripheral surface of the elements 150 preferably being coated with a suitable dielectric material such as porcelain, epoxy or the like except for those bare surface portions thereof conductively relating to the wires 67 and the bars 110.

As will be seen, in this emobodiment of the invention the electrically conductive elements remain fully isolated from one another.

FIG. 11 of the drawings exhibits a further embodiment of the invention which includes parts and is assembled like the embodiment of FIGS. 1–9 except for the following exceptions.

The outer sleeve 10' thereof which forms the upper portion of its housing structure, as applied to a wellhead 140, is shortened as to its length. As seen from FIG. 11, the lower end 14' of the sleeve 10', which is in this case located immediately below and in spaced relation to the lower end surface of the body of insulating material has a counterbore, at the inner end of which it forms a narrow annular shoulder. Nested in this counterbore, to fill the same and have an outer peripheral portion of its upper surface abutted to this narrow annular shoulder, is the disc 62, the O-ring 66 in the outer periphery of which forms a seal between it and the bounding wall surface of the counterbore. The disc 62 in this position is in adjacent closely spaced relation to the undersurface of the insulator body 30, a layer of dielectric 102 being interposed therebetween. As in the first instance the disc 62 may be of brass or a ceramic such as an alumina ceramic material. In the latter case the inner surfaces of its opertures 64 are metallized.

The diameter of the lower end portion of the sleeve 10', from its end 14' up to the lower limit of the groove 80' in its outer surface, which corresponds to the groove 80 in the outer surface of the sleeve 10, is reduced so that it is inset from the outer surface of that portion of the sleeve 10' which bounds the groove 80' at its uppermost limit.

The fitting 88' corresponds to the fitting 88 of the embodiment of FIGS. 1–9 except for the following exceptions. Its length is increased in proportion to the reduction in length of the sleeve 10'. Also facing upper end portions of the inner surfaces of its mating halves 90' are modified to produce therein and circumferentailly thereof a groove immediately below its upper end which forms at its upper end an internal flange 98'. As the fitting 88' comprised of its mating halves is applied in this case, its upper end portion overlaps the reduced diameter lower end portion of the sleeve 10' in the process of which the flange 98' seats in the groove 80' and clamps about and to its base, as shown in FIG. 11. At the same time the groove formed in the upper wall of fitting 88' immediately below the flange 98' is filled by the length of the outer portion of the sleeve 10 defined between the lower of the radial wall surfaces bounding the groove 80' and its end 14'. The radial limit of the lower of the radial surfaces defining the vertical limits of the groove below the flange 98' is greater than that of the upper thereof and as it abuts the sleeve end 14' it extends radially inward thereof to overlap an outer peripheral portion of the lower surface of the disc 62, thereby to firmly clamp the disc to the annular shoulder at the inner end of the counterbore in the lower end of the sleeve 10'. The pocket thus defined by the fitting 88' and the undersurface of the disc 62 is completely filled with the flexible dielectric material 102 which encases the portions of the cable 74 and sheathed wires thereof which project through the fitting and through the apertures 64 of the disc 62 to which they are fixedly connected and by which they are now fixedly supported.

In this embodiment the disc 62 is rigidly clamped and a complete seal is formed across the lower end of the sleeve 10 and in a backing relation to the insulator body 30. The benefits of this simple construction are believed obvious. A maximum defensive enclosure of the critical elements of the electric feedthrough unit is achieved.

In any case the disc 62 may be either of brass or its equivalent or of a ceramic material modified as described.

For that matter, an apertured disc such as the disc 62, formed of a ceramic, preferably alumina ceramic, for example, may be employed at and abutted to either or both of the opposite ends of the insulator 30 to substantially increase its strength in either or both directions. For example, in packer penetrator applications, the ability to withstand pressure from either direction may be necessary. In fact with such a modification the solid rigid cylinder of insulating material 30 can, if desired, be made of a lower strength less expensive material as it no longer bears the load resulting from well fluid pressures.

As should be obvious, where necessary the dielectric 102 applied in the various embodiments of the present invention herein described is introduced through suitable openings in the structure thereof, which openings are appropriately sealed once the dielectric is properly and fully introduced.

The improvements of the present invention achieve all the stated objectives and provide the benefits and advantages above described. Other points to be considered in connection with the advantages of the present invention over the prior art include the following. The extension of the sleeve 10 or 10', as the case may be, by the clam shell type fitting per the preferred of the embodiments of the present invention and its resulting function not only insures a better seal of the lower end of the electric feedthrough unit as applied to the wellhead but also enables a relief of strain on the cable applied to the electrically conductive elements 50. The clam shell type fitting is also effective to prevent a seepage therethrough of well fluids as often occurs in electric feedthrough units of the prior art, at the end thereof which is exposed to the interior of a well. The result is to eliminate a number of potentially derivative problems.

Most importantly, in the use of the invention embodiments herein described and others that will be obvious therefrom there need be little concern that they will release toxic or deadly gases therethrough from a well to which they apply.

It must be remembered the invention embodiments are not dependent for their highly improved performance on an actual bonding of the insulator body 30 to the sleeve 10 or 10' or bonding to the elements 50 and there need not be perfect bonding or perfect homogeneity of the flexible dielectric material to insure successful operation. Another important feature of the invention units is that they may be constructed in the manner described to withstand pressures of 20000 psig without failure, thereby insuring against catastrophe in use thereof. As will be obvious, the invention embodiments are characterized by a higher reliability and longer life than devices of the prior art directed to the same purpose.

There is one further point to be considered. The relative locations of the seals applied in the invention embodiments, particularly those of the seals applied about the insulator body 30 and in association with the electrically conductive elements 50, 150 afford additional insurance against problems that have been found to exist in prior art devices. An example of such problems has been the occurrence of undue pressures on the electrically conductive elements that has caused displacement of parts and/or failure of the connections thereto with resulting malfunction.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. An electric feedthrough unit particularly applicable to a wellhead to interconnect an aboveground source of power with underground equipment comprising a generally tubular structure of steel or other material having like properties of strength and resistance to distortion, a rigid body of an insulating material having a high dielectric strength, such as alumina ceramic, positioned within said tubular structure at a location intermediately of and spaced from its respective ends, one of said ends constituting an upper end and the other a lower end when said electric feedthrough unit is applied to a wellhead for use, electrically conductive elements contained within and in recessed relation to the outer surface of said rigid body, said tubular structure having an inner wall surface including thereon means defining an annular shoulder which extends transversely of said tubular structure and is spaced from its ends, one end portion of said body being in a directly abutted relation to said shoulder which precludes said body from movement toward said upper end of said tubular structure, said body having an outer peripheral surface portion thereof in a contacting bearing relation to said inner wall surface of said tubular structure, a length of armored cable having sheathed conductive wires contained therein and extending the length thereof, at one end portion of said cable said contained wires being exposed, their respective extremities bared and each respectively connected in an electrically conductive relation to one of said elements, said cable extending from said elements and said rigid body through and from said lower end of said tubular structure, the opposite end portion of said cable being adapted for connection of said wires to deliver power to underground equipment, closure means clamped to and about said tubular structure and said cable adjacent said lower end of said tubular structure to form a chamber located between said rigid body and said closure means, said chamber being charged and filled with a flexible dielectric material, such as an epoxy which is flexible when cured, said flexible dielectric complementing and being shaped by an interior surface of said closure means and forming a seal within and across said lower end portion of said tubular structure, about and in supporting relation to the portions of said cable therein, precluding the entry to the lower end of said tubular structure and passage therethrough of fluids and operative to receive and transmit to and through said rigid body to said shoulder such forces, stresses and strains as are applied thereto, directly or indirectly, when exposed to an environment of high temperatures and pressures and highly volatile or otherwise dangerous fluid, thereby to obviate chance occurrence of dangerous and catastrophic events in use of said electric feedthrough unit.

2. An electric feedthrough unit as in claim 1 wherein a disc unit is positioned within, transversely of and in bridging sealing relation to said inner wall surface of said tubular structure adjacent the end of said right body remote from said shoulder, said disc having apertures complementary to and accommodating the projection therethrough of sheathed portions of said wires of said cable the bared ends of which respectively extend to connect to said elements, said disc being so formed to receive and uniformly distribute the stresses and strains applied to and through said flexible dielectric to said tubular structure by way of said rigid body.

3. Apparatus as in claim 1 wherein said rigid body has a generally cylindrical configuration which in cross section is complementary in dimension to that of said inner surface portion of said tubular structure by which it is bounded and said body has a plurality of through bores extending from end to end thereof including bores in each of which one of said electrically conductive elements is relatively fixed.

4. Apparatus as in claim 3 wherein said elements are positioned in their respective bores intermediate the end thereof and have means associated therewith in abutment with means in connection with the bounding walls thereof which establishes them so they extend in a direction longitudinally of said bores and prevents them from moving outwardly of said bores in the direction of said upper end of said tubular structure.

5. Apparatus as in claim 4 wherein each of said elements is established in a radially spaced relation to the bounding wall of its bore and out of contact therewith by an annular disc of rigid dielectric material which forms at least part of said associated means.

6. Apparatus as in claim 3 wherein each of said elements has an elongate rod-like form and means define a seal thereabout between an intermediate portion of its length and the bounding wall of the bore in which it is lodged, there being means preventing longitudinal movement of each element within its bore which precludes the movement thereof in the direction of said upper end of said tubular structure.

7. Apparatus as in claim 3 wherein said bores are parallel and each has a counterbore at the end thereof facing inwardly of said tubular structure, said bores each contain one said element which is rod-like in form and stepped as to its dimension to produce on its outer surface an annular shoulder facing in the direction of said upper end of said tubular structure, the counterbore of each said bore provides therein an annular shoulder facing oppositely of said shoulder on said electrically conductive element therein and said element in each said bore having thereabout and between said shoulders means which establish a relatively fixed position thereof with reference to the length of its bore and a seal thereabout between it and the wall of the bore by which it is bounded.

8. Apparatus as in claim 2 wherein said disc unit bears on and coextensively with the end of said rigid body remote from said upper end of said tubular structure and its surface remote from said upper end defines the end of said chamber remote from said closure means.

9. An electric feedthrough unit as in claim 1 wherein a metal sleeve is applied about and in a pressure tight relation to a sheathed portion of each of said wires of said cable located within said flexible dielectric within the longitudinal limits of said chamber, in a spaced relation to the bared extremity thereof connected to one of said electrically conductive elements, said sleeves having a sealing relation with and to the flexible dielectric thereabout which contributes, together with said closure means, to the support of said cable in the extension thereof to the equipment to which said electric feedthrough unit delivers power.

10. An electric feedthrough unit as in claim 2 wherein said closure means defines an extension of said tubular structure and said chamber and there is a pressure tight interfit of said closure means to and about said lower end portion of said tubular structure and to and about said cable at a location spaced longitudinally from said lower end of said tubular strucure.

11. An electric feedthrough unit as in claim 10 wherein said disc is in an adjacent closely spaced relation to said rigid body and a layer of said flexible dielectric interposed between said disc and said body and the portions of said electrically conductive elements to which said wires of said cable are connected.

12. An electric feedthrough unit as in claim 1 wherein said rigid body has a plurality of throughbores arranged to extend longitudinally of said tubular structure, one of said electrically conductive elements being positioned in each said throughbore, each said throughbore being counterbored at the end thereof most adjacent said lower end of said tubular structure to form in its bounding wall surface a radial shoulder, each said element having in association therewith means forming a radial projection therefrom having a limiting abutment thereof to said shoulder precluding displacement thereof in the direction of said upper end of said tubular structure, said radial projection having associated therewith a sealing element which is in an adjacent spaced relation to said shoulder, thereby to define a seal across each counterbore in which a said element is located.

13. Apparatus as in claim 1 providing an electric feedthrough unit including a device for use in coupling said electrically conductive elements to a source of aboveground power comprising a pipe-like housing, a further length of electrical cable and copper bars, each of said bars being adapted for a releasable interconnection thereof to one of said electrically conductive elements a bared extremity of which is exposed adjacent and spaced inwardly of said body and said upper end of said tubular structure, one end of said further cable being projected within one end of said housing and the remainder thereof being extended outwardly from said one end of said housing, said further cable having sheathed conductors therein which at the end thereof remote from said pipe-like housing are adapted for connection to a source of power, the opposite ends of said conductors of said further cable having their extremities within said housing bared and respectively connected and conductively related to one end of one of said bars the opposite end portion of which projects outwardly of the opposite end of said housing, said housing being filled, about the portion of the cable therein and the sheathed conductors thereof, with a charge of flexible dielectric material encasing the connections between said bars and said conductors, portions of said dielectric material being extended from said opposite end of said housing to form a sleeve-like sheath thereof peripheral to and about the projected portions of said bars, said sheathed projections of said bars being telescopically applied to portions of bores provided in said rigid body offering access to said exposed extremities of said electrically conductive elements therein to conductively relate said bars and said elements and provide that said dielectric sheaths are wedged in and in sealing relation to said bores, thereby to provide a protective seal of the connections of said bars to said electrically conductive elements and said housing providing means to produce a telescopic fit thereof to said one end of said tubular structure and a seal therebetween.

14. Apparatus as in claim 1 wherein said outer peripheral surface portion of said rigid body has interposed between it and the bounding inner surface portion of said tubular structure a sealing means which is in an adjacent relatively closely spaced relation to said end portion of said body which abuts said shoulder.

15. Apparatus as in claim 14 wherein said rigid body has a generally cylindrical configuration and a plurality of generally parallel throughbores extending from end to end thereof, each of said bores including therein one of said electrically conductive elements which is rod-like in form and relatively fixed with sealing means being provided between an intermediate portion of its length and the bounding wall of said bore, said sealing means including an annular seal the level of which is in a closely spaced relation to that of said seal provided between said rigid body and the bounding portion of the inner wall surface of said tubular structure.

16. Apparatus as in claim 1 including means defining a pair of oppositely facing longitudinally spaced shoulders exterior to and along the length of said electric feedthrough unit, one of said shoulders being adjustable relative the other, one of said shoulders being in an adjacent spaced relation to said upper end and another being provided at a location corresponding to a position intermediate the length of said chamber, the form of said electric feedthrough unit so provided facilitating the application thereof in a bore provided for the same in a wellhead to have one said shoulder abut an end portion of the wellhead which is lowermost in use thereof and the other said shoulder abut the outermost end of said wellhead, the means defining said shoulders providing means to clamp to the respective ends of said wellhead and fix the position of said electric feedthrough unit, as required, with said cable dependent therefrom and having a secure connection to the underground equipment to be powered in use of said electric feedthrough unit.

17. Apparatus as in claim 1 wherein said closure means defines an extension of said tubular structure, there is a pressure tight interfit of said closure means to and about said lower end portion of said tubular structure and to and about said cable at a location spaced longitudinally from said lower end of said tubular structure, a rigid dielectric disc unit is positioned within, transversely of and in bridging sealing relation to said inner wall surface of said tubular structure adjacent the end of said rigid body remote from said shoulder, said disc unit having apertures complementary to and accommodating the projection therethrough of sheathed portions of said wires of said cable the bared extremities of which respectively extend to connect to said elements, said disc unit being so formed to receive and uniformly distribute the stresses and strains applied to and through said flexible dielectric to said tubular structure by way of said rigid body and said disc unit is clamped between facing portions of said tubular structure and said closure means forming an extension thereof to define one end of said chamber the opposite end of which is defined by a portion of said closure means including that portion which is interfit to and about said cable.

18. An electric feedthrough unit particularly advantageous for application to a wellhead for use in connecting an aboveground source of power to underground equipment comprising a tubular structure of steel or other material having like properties of strength and resistance to distortion, a rigid body of an insulating material having high dielectric strength, positioned within said tubular structure in a location intermediately of and spaced from its respective ends, one of said ends constituting an upper end and the other a lower end when said electric feedthrough unit is applied to a wellhead, said tubular structure having an inner wall surface including a step forming thereon a transversely directed annular shoulder which is faced toward said lower end thereof, an outer peripheral surface portion of said rigid body being complementary to and bearing on said inner wall surface, said body having an annular surface which directly abuts said shoulder, a non-conductive substantially rigid disc unit forming a seal bridging the interior of said tubular structure adjacent and in backing relation to the end of said body most adjacent said lower end of said tubular structure, said body having a plurality of bores, within and in a recessed relation to each of which is a rod-like electrically conductive element having a relatively fixed position with reference to the bonding wall thereof, said disc having apertures therein each of which is aligned with one of said bores, a length of armored cable having sheathed conductive wires contained therein and extending the length thereof, one end portion of each of said wires being extended through and in sealing relation to one of said apertures in said disc and into the bore aligned therewith to have the projected extremity thereof, which is bared, connected in an electrically conductive relation to the adjacent end of the element therein, said cable extending from said body to, through and from said lower end of said tubular structure, the opposite end portions of said wires being adapted for connection to power underground equipment, closure means one portion of which is clamped to and about said tubular structure at said lower end thereof and another portion of which is clamped about a portion of said cable to form therewith a seal across said lower end of said tubular structure and define a chamber, said chamber being charged and filled with a flexible dielectric material, such as an epoxy which is flexible when cured, said flexible dielectric being in backing relation to said disc and complementing and being shaped by an interior surface of said closure means to provide a secure seal across the lower end of said tubular structure and that any stress and strain applied thereto and therein by high pressure and temperature conditions of the surrounding environment and attacks by volatile and noxious fluids in said environment is essentially dispersed and dissipated to the extent to obviate chance occurrence of dangerous and catastrophic events in use of said electric feedthrough unit.

19. Apparatus as in claim 18 wherein said bores in said body are parallel and each has a counterbore of the end thereof facing inwardly of said tubular structure, said bores each contain one said rod-like element which is stepped as to its cross sectional dimension to produce on its outer surface an annular shoulder facing in the direction of said upper end of said tubular structure, the counterbore of each said bore provides therein an annular shoulder facing oppositely of said shoulder on said electrically conductive element contained in said bore and said element in each said bore having thereabout and between said shoulders means which establish a relatively fixed position thereof with reference to the length of its bore and a seal thereabout and about its connection to a cable wire.

20. An electric feedthrough unit as in claim 19 wherein said closure means defines an extension of said tubular structure and said chamber and there is a pressure tight interfit of said closure means to and about said lower end portion of said tubular structure and to and about said cable at a location spaced longitudinally from said lower end of said tubular structure.

21. Apparatus as in claim 19 wherein said outer peripheral surface portion of said rigid body has interposed between it and the bounding inner surface portion of said tubular structure a sealing means which is in an adjacent relatively closely spaced relation to said end portion of said body which abuts said shoulder.

22. Apparatus as in claim 21 wherein said rigid body has a plurality of generally parallel throughbores extending from end to end thereof, each of said bores including therein one of said electrically conductive elements which is rod-like in form and relatively fixed with reference to said body with sealing means being provided between an intermediate portion of its length and the bounding wall of said bore, said sealing means including an annular seal the level of which is in a closely spaced relation to that of said seal provided between said rigid body and the bounding portion of the inner wall surface of said tubular structure.

23. An electric feedthrough unit particularly advantageous for application to a wellhead for use in connecting an aboveground source of power to underground equipment comprising a tubular structure of steel or other material having like properties of strength and resistance to distortion, a rigid body of an insulating material having high dielectric strength positioned within said tubular structure in a location intermediately of and spaced from its respective ends, one of said ends constituting an upper end and the other a lower end when said electric feedthrough unit is applied to a wellhead, said tubular structure having an inner wall surface including a step forming thereon a transversely directed annular shoulder which is faced toward said lower end thereof, an outer peripheral surface portion of said rigid body being complementary to and bearing on said inner wall surface, said body having an annular surface which directly abuts said shoulder, said body having a plurality of bores, within and in a recessed relation to each of which is a rod-like electrically conductive element having a relatively fixed position with reference to the bounding wall thereof, a length of armored cable having sheathed conductive wires contained therein and extending the length thereof, one end portion of each of said wires being extended to one of said bores and there connected in an electrically conductive relation to the adjacent end of the element therein, said cable extending from said body to, through and from said lower end of said tubular structure, the opposite end portions of said wires being adapted for connection to power underground equipment, closure means one portion of which is clamped to and about said tubular structure at said lower end thereof and another portion of which is clamped about a portion of said cable to form therewith a seal across said lower end of said tubular structure and define a chamber, said chamber being charged and filled with a flexible dielectric material, such as an epoxy which is flexible when cured, a metal sleeve being applied about and in a pressure tight relation to a sheathed portion of each of said wires of said cable located within said flexible dielectric within the longitudinal limits of said chamber, in a spaced relation to the bared extremity thereof connected to one of said electrically conductive elements, said sleeves having a sealing relation with and to the flexible dielectric thereabout which contributes, together with said closure means, to the support of said cable in the extension thereof to the equipment to which said electric feedthrough unit delivers power, said flexible dielectric being in backing relation to said body and complementing and being shaped by an interior surface of said closure means to provide a secure seal across the lower end of said tubular structure and that any stress and strain applied thereto and therein by high pressure and temperature conditions of the surrounding environment and attacks by volatile and noxious fluids in said environment is essentially dispersed and dissipated to an extent to obviate chance occurrence of dangerous and catastrophic events in use of said electric feedthrough unit.

24. Apparatus as in claim 23 wherein said outer peripheral surface portion of said rigid body has interposed between it and the bounding inner surface portion of said tubular structure a sealing means which is in an adjacent relatively closely spaced relation to said end portion of said body which abuts said shoulder.

25. Apparatus as in claim 24 wherein said bores in said rigid body include a plurality of generally parallel throughbores extending from end to end thereof, each of said bores including therein one of said electrically conductive elements which is rod-like in form and relatively fixed with reference to said body with sealing means being provided between an intermediate portion of its length and the bounding wall of said bore, said sealing means including an annular seal the level of which is in a closely spaced relation to that of said seal provided between said rigid body and the bounding portion of the inner wall surface of said tubular structure.

* * * * *

UNITED STATES PATENT AND TRADEMARK OFFICE

CERTIFICATE OF CORRECTION

PATENT NO. : 4,583,804

DATED : April 22, 1986

INVENTOR(S) : Richard Thompson

It is certified that error appears in the above-identified patent and that said Letters Patent is hereby corrected as shown below:

Col. 3, line 16, "conencted" is corrected to read -- connected --.

Col. 5, line 48, "hightly" is corrected to read -- highly --.

Col. 6, line 1, "Ad" is corrected to read -- An --.

Col. 19, line 23, "opertures" is corrected to read -- apertures --;

line 37, "tailly" is corrected to read -- tially --.

Col. 23, line 17 (Claim 10, line 7) "strucure" is corrected to read -- structure --.

UNITED STATES PATENT AND TRADEMARK OFFICE

CERTIFICATE OF CORRECTION

PATENT NO. : 4,583,804

DATED : April 22, 1986

INVENTOR(S) : Richard Thompson

It is certified that error appears in the above-identified patent and that said Letters Patent is hereby corrected as shown below:

Col. 3, line 26, "bonding" is corrected to read -- bounding --;

line 53, "interruption" is corrected to read -- interrelation --.

Col. 5, line 36, "be" is corrected to read -- the --.

Col. 6, line 9, -- with -- is inserted following "make".

Col. 16, line 60, "frame" is corrected to read -- flame --.

Col. 22, line 9 (Claim 2, line 4) "right" is corrected to read -- rigid --.

Col. 25, line 30 (Claim 18, line 26) "bonding" is corrected to read -- bounding --.

Signed and Sealed this

Eleventh Day of November, 1986

*Attest:*

DONALD J. QUIGG

*Attesting Officer* *Commissioner of Patents and Trademarks*